US006507275B2

(12) United States Patent
Romano et al.

(10) Patent No.: US 6,507,275 B2
(45) Date of Patent: Jan. 14, 2003

(54) PILL DISPENSING REMINDER SYSTEM FOR INDICATING WHEN TO TAKE A SPECIFIC PILL

(76) Inventors: Irit Romano, Rehov Ha Ma-Agal #11, Apt. 2, Givatiam (IL); Reuben Bahar, 23708 Welby Way, West Hills, CA (US) 91307

( * ) Notice: Subject to any disclaimer, the term of this patent is extended or adjusted under 35 U.S.C. 154(b) by 0 days.

(21) Appl. No.: 09/835,134

(22) Filed: Apr. 16, 2001

(65) Prior Publication Data

US 2002/0149473 A1 Oct. 17, 2002

(51) Int. Cl.[7] ..... G08B 1/00

(52) U.S. Cl. ..... 340/309.15; 340/573.1; 340/693.5; 340/825.19; 368/10

(58) Field of Search ..... 340/309.15, 309.4, 340/573.1, 693.5, 3.21, 825.19; 368/10, 107, 108, 109

(56) References Cited

U.S. PATENT DOCUMENTS 5,181,189 A 1/1993 Hafner
5,408,443 A * 4/1995 Weinberger ..... 368/10
5,669,503 A 9/1997 Robin
5,915,558 A 6/1999 Girvetz
5,954,225 A 9/1999 Powe
6,021,902 A 2/2000 Wu

* cited by examiner

*Primary Examiner*—Daryl Pope
(74) *Attorney, Agent, or Firm*—Edgar W. Averill, Jr.

(57) ABSTRACT

A pill dispensing reminder for assisting a patient to remember to take one or more pills at a preferred time. A microprocessor is held in a case and the microprocessor includes a 24 hour clock and outputs information to both a warning indicator and a data display window at programmed times. The microprocessor is connected to a data link interface which is capable of receiving programming information. A programming information sending unit exists separately from the case and is located at a pharmacy, doctor's office, health food store, or with the user. It includes a data link interface which mates with the data link interface held by the case. The case may include one or more pill compartments. A warning signal transmission unit may also be provided separately from the case and may transmit a warning signal generated from the case to a mobile or stationary receiver via wireless or wired output.

14 Claims, 3 Drawing Sheets

PILL DISPENSING REMINDER SYSTEM FOR INDICATING WHEN TO TAKE A SPECIFIC PILL

BACKGROUND OF THE INVENTION

The field of the invention is dosage reminder systems and the invention relates more particularly to a system for reminding a user when to take a specific pill.

There has been a long term trend of developing new drugs and nutritional supplements which have greatly improved the control of numerous diseases as well as improving the health of the user. There has also been a long term increase in life expectancy. This combination of trends has led to both a tendency to require the taking of more than one medicine by a patient as well as a tendency for the patient to be of advanced years and in need of assistance in remembering when a specific medicine is to be taken.

For instance, a patient with advanced asthma may often be required to take a decongestant on an empty stomach before breakfast, one or more once-a-day medicines at breakfast, a plurality of inhalers, some once a day, some three times a day, an antibiotic taken with meals, and a one-a-day medicine at bedtime. Many medical doctors find that their patients forget one or more of these regimens and, as a result, do not receive the benefit which is available to them.

Numerous pill dispensing systems have been devised in an effort to help patients with this problem. One such device is shown in the Hafner U.S. Pat. No. 5,181,189, which shows a device for the storage and time-regulated dispensing of drugs. Unfortunately, the device works only on a single drug. The device receives dosage information from the medicine container.

U.S. Pat. No. 5,669,503 to Robin shows a medication dose control system which has a housing with a central cylinder. The housing has a plurality of separate dispensing chambers. The system includes a central dispensing cylinder, including eight separate dispensing chambers which must be filled by the user. The user also has to manipulate the alarm setting means, as well as rotating the dispensing cylinder when an alarm has been sounded. Such steps are difficult for many users.

U.S. Pat. No. 5,915,558 to Girvetz shows a pillbox in the shape of a pager. It includes an alarm clock and an enclosed case which holds preferably a multi-compartment container. It has a display for displaying information such as the time, any alarm setting, and the pill to be taken when the alarm goes off. A plurality of buttons 32 are provided on the exterior of the device for entering information into the memory. In light of this, however, a relatively high amount of sophistication and patient care is required to properly program and use the device.

U.S. Pat. No. 5,954,225 to Powe shows a pill dispenser with a plurality of compartments, each having a pivoting lead. A light-emitting diode is positioned adjacent to each compartment. A clock and an alarm includes means for lighting one of the compartments at a time which is set by the user. The user is required to set the alarm via switch 28 and there is a separate alarm event for each pill compartment. Once again, a relatively high amount of sophistication and patient care is required to properly program and use the device.

U.S. Pat. No. 6,021,902 to Wu shows a medicine container which reminds the user of the time to take medicines, and includes a case having a plurality of compartments. The cover includes a plurality of keys for setting times of taking medicines as well as a display and sound generator for giving warning sounds when a medicine is to be taken. Once again, the user must be relatively sophisticated to program the device in a useful manner.

Thus, although there are many pill reminding systems, they all have two significant shortcomings. The first and most important shortcoming is that the user is required, with the exception of the Hafner device, to input dosage time information into the device. Inputting such information is often tedious, complicated and confusing, given the push-button means provided to accomplish this task. Secondly, since the dosage information inputting means are limited to a relatively small number of buttons, again with the exception of the Hafner device, the information which is outputted is very limited.

There is, thus, a need for a medicament dispensing reminder which need not be programmed by the user, but instead, can be programmed by a health professional, and which includes a reminder alarm, and is capable of displaying far more detailed information that is of help to the user. Preferably, for instance, a pharmacist would have a device which inputs data to the microprocessor in the reminder. Data may include, but is not limited to, time interval information, drug name information and even drug warning information, such as "take with meals." Since memory for the microprocessor and the reminder are relatively inexpensive, a great deal of important information may be inputted into the reminder. Furthermore, because the pharmacist can spread the cost over a large number of customers, a relatively sophisticated data inputting machine or computer is cost and task effective. Alternatively, in situations where the user may need to input drug information themselves, a computer program provided with the reminder or located online will tremendously simplify the task. In this respect, all the user would need to do is input the drug information into the computer program and download it into the reminder. Because both of these methods for inputting data require relatively little or no sophistication by the user, they significantly reduce the problems of programming associated with existing medicament dispensing systems, and thereby tremendously increase the utility of those devices.

BRIEF SUMMARY OF THE INVENTION

The present invention is for a medicament dispensing reminder for assisting a patient to remember to take one or more medicaments at a preferred time. The reminder includes a case for supporting a microprocessor. The microprocessor has timing circuitry which includes a 24 hour clock and a memory module capable of receiving and sending medicament identifying indicia to an output port which may be connected to, for instance, a liquid crystal display screen. A data link interface is held by the case for receiving programming information for inputting medicament dosage times, conditions and name-identifying indicia for one or more time intervals for each successive 24 hour period. A warning indicator is held by the case which includes means to produce an output signal at a time when a particular medicament is to be taken. The case may also support one or more compartments for holding specific medicaments.

DESCRIPTION OF THE PREFERRED EMBODIMENTS

Figure 1:
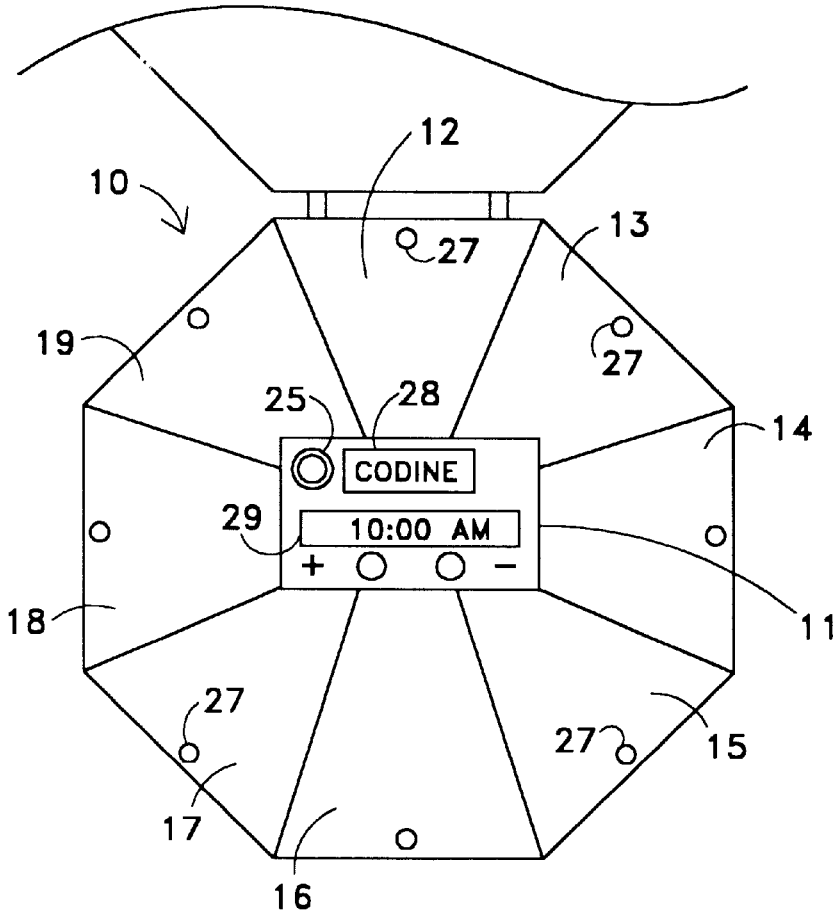
FIG. 1 is a plan view of a medicament dispensing reminder, including a plurality of pill-holding compartments.

A medicament dispensing reminder is shown in plan view in FIG. 1 and indicated generally by reference character 10. Reminder 10 has a case 11 which has eight compartments 12, 13, 14, 15, 16, 17, 18, and 19. These compartments are used to store medicaments. The term "medicaments" as used herein is intended to include any digestible vitamin, mineral, or medicine in an oral dosage form, such as a tablet or capsule and is not intended to be limited to prescription drugs. Additionally, the term is intended to include nutritional supplements and other over-the-counter pills or capsules taken by users. Finally, the term may also refer to medicines in liquid or pressurized form (such as injections, syrup or inhalers) which will be stored outside the medicament compartments.

Figure 2:
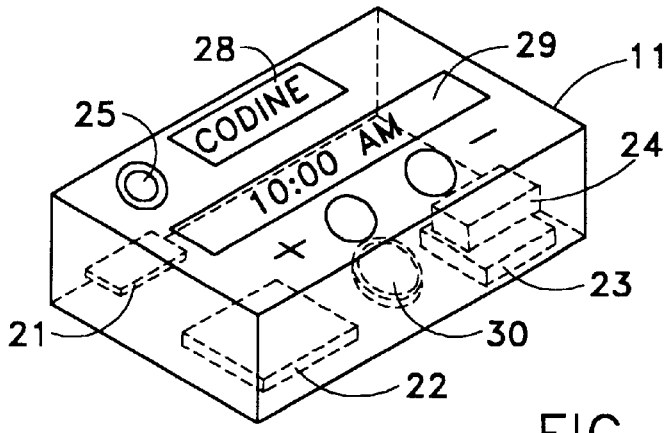
FIG. 2 is a diagrammatic perspective view of the microprocessor of FIG. 1.

Case 11, in FIG. 2, is shown in perspective view without the pill-holding compartments in FIG. 1. The case 11 may be provided independently of the pill-holding compartments and is the heart of the invention. Case 11 includes a microprocessor 20, which includes means for programming 21, data output means 22, and timing circuitry 23, which includes a 24 hour clock. A memory module 24, preferably non-volatile, is included in microprocessor 20 shown in perspective view in FIG. 2, and the memory module is capable of sending medicament identifying indicia to data output port 22 to identify an individual medicament at a pre-programmed time. Memory module 24 is also capable of receiving medicament identifying indicia from the means for programming 21.

A data link interface 25 is held by the case for receiving programming information relating to medicament dosage times, conditions, and name-identifying indicia. The term "conditions" as used herein and in the claims is intended to include, but is not limited to, directions for taking medicament, such as "take with food," "to be taken twice a day," or "do not take X medicament if taking Y medicament." Additionally, the term is intended to include patient medical history and their pertinent medical condition(s). Information such as this is often extremely important and possibly life critical. Although the data link interface 25 is shown as a port through which a direct wire connection to the microprocessor 20 may be established, the data link interface 25 may also include or be an infrared port which allows for wireless data transfer utilizing infrared technology.

A warning indicator is energized by microprocessor 20 and may output a signal at a time when a medicament is to be taken. The signal may be an audible alarm, a luminous alarm (such as LED 27 or a luminous LCD), a vibrating alarm, or any combination of the three, which work in conjunction with a data display window 28. A second data display window 29 is a time display unit, which, of course, may be on the same screen as data display window 28. Preferably, the data display window is a liquid crystal display unit and is capable of outputting the name of the drug and, preferably, conditions, such as whether to take with meals and the like. A wafer battery 30 provides power to the microprocessor, although, of course, this could be provided by an external transformer, if desired.

Figure 3:
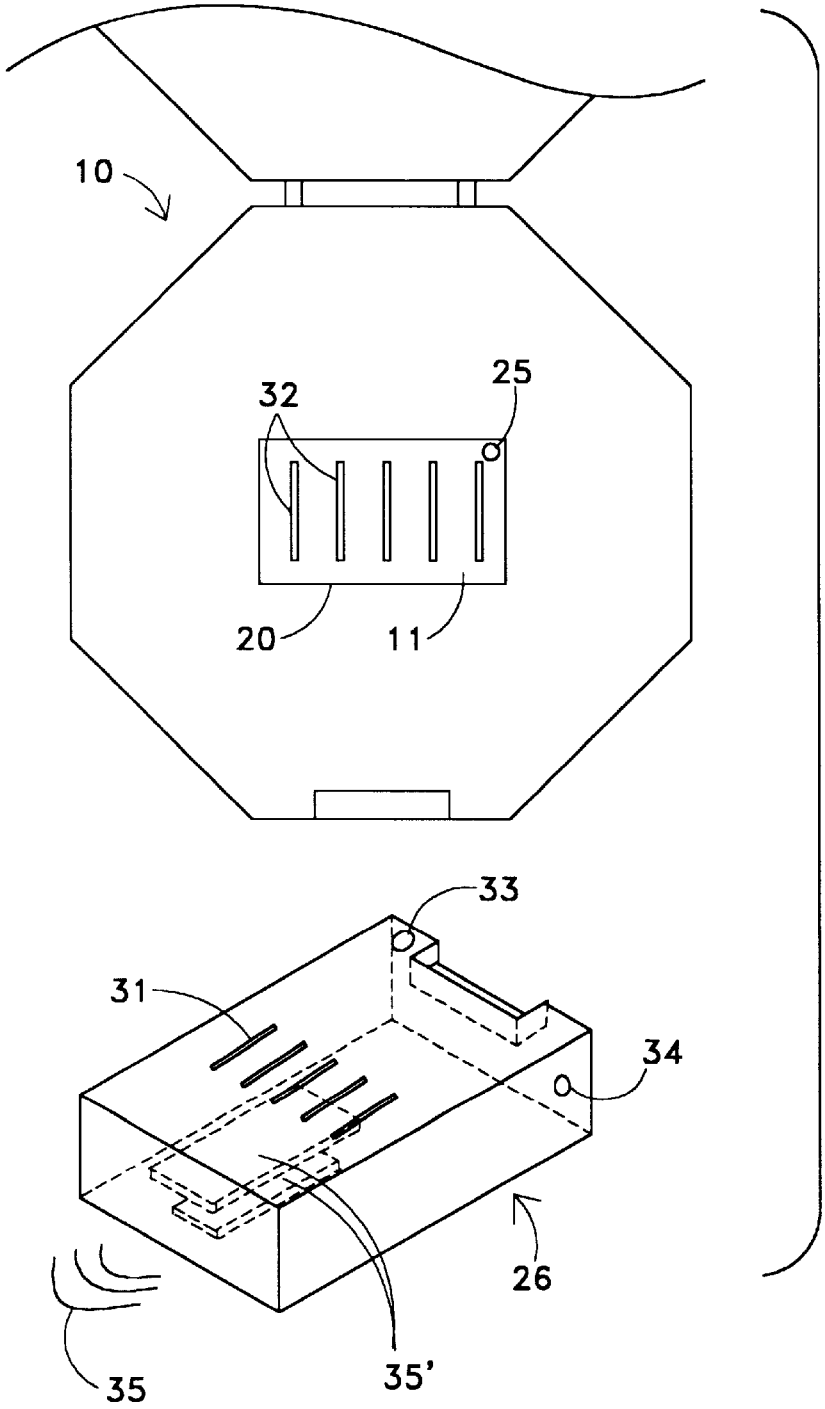
FIG. 3 is a perspective view of a unit for sending a warning signal generated from the microprocessor of the medicament dispensing reminder of FIG. 1 to a mobile wireless receiver.

The memory of microprocessor 20 and its associated program is capable of storing data for more than one medicament. Thus, someone who takes five different medicines each day will be able to store independent data for each of these medicines. These data would include individual time settings, conditions, and name identifying indicia which can be displayed on data window 28. It is also possible for the microprocessor 20 to output a signal to an individual LED 27 on the particular compartment where the medicament to be taken is contained. Alternatively, or in addition, microprocessor 20 may output a signal to an audible or vibrating alarm at the time when a medicament is to be taken. Finally, the microprocessor 20 may output a signal to a warning unit 26 shown in FIG. 3 of the drawings.

Warning unit 26 is capable of generating an alert signal indicating when a medicament is to be taken. Warning unit 26 has an interface connector 31 which may be plugged into a plurality of conductors 32 on microprocessor 20. Additionally, warning unit 26 may also be connected to microprocessor 20 via a link between device connection port 33 and data link interface 25. In both respects, warning unit 26 will be able to communicate with microprocessor 20 and function in accordance with the data stored in microprocessor 20. Linking microprocessor 20 to warning unit 26 will produce a united device that possesses the combined functions and capabilities of both the microprocessor 20 and warning unit 26. Warning unit 26 could be used in nursing homes or other locations where a caregiver is available to a patient and may be alerted by the signal generated by warning unit 26. Upon being alerted, the caregiver can immediately attend to the patient and administer the appropriate medicament. The alert signal generated by the warning unit 26 can be a wireless transmission signal 35 sent to a mobile or stationary receiver or an audible alarm. Additionally, the warning unit could generate and send a signal to data output port 34, which could be wired to a stationary alerting unit located at the patient's bed or near the attending staff.

An important feature of the present invention is the manner in which microprocessor 20 is programmed. Unlike most prior art reminder systems, the user does not need to program the microprocessor 20, but instead, the medicament professional preferably does so. This is because medicament information may be more reliably inputted by the medicament professional who is knowledgeable about the matter and would most probably have gotten the data from the manufacturer or some other reliable source. Furthermore, having the medicament professional program, the reminder will most probably result in a great deal more information being inputted into memory module 24 of the microprocessor 20. Programming of microprocessor 20 by a medicament professional can be done in a number of ways. Preferably, the data is inputted into microprocessor 20 via the data link interface 25. Alternatively, data can also be entered into microprocessor 20 via a data connection established with the plurality of conductors 32 that are located on microprocessor 20. To input the data, a medicament professional can use an external data inputting machine or a computer (such as a PC).

It is also contemplated that the user of the reminder would be able to personally input data into microprocessor 20. Allowing the user to do this is especially beneficial as there may be times when it is unrealistic for the medicament professional to input the data. For example, a user who is taking over-the-counter medicaments on a set schedule may want to input data pertaining to those medicaments into the reminder. Although the medicament professional would be able to do this task, the user may simply have forgotten to make the request or had acquired the over-the-counter medicament after their visit to the medicament professional. In both of these scenarios, it would be inefficient and unpractical to have the medicament professional program the reminder. Having the user program the reminder himself would, thus, significantly increase its use and utility. In order to simplify this task, preferable the user would program microprocessor 20 by entering data into a computer program and subsequently download that data into the reminder via the data line interface 25. The computer program can be supplied to the user on a disk or made available online and would allow data to be entered through the use of a personal computer. Typing medicament information into a computer would require relatively little sophistication from the user and, therefore, presents a method of user data input that avoids the complexities associated with prior art reminder systems.

It is also useful to have the case 11 totally independent of the medicine compartments and the medicines which can be stored in their original packaging containers. This is possible because relatively inexpensive microprocessors can output alpha/numeric information sufficient to inform the user of what medicament to take. After receiving the warning signal, the user can independently retrieve and take the appropriate medicine. Using the case 11 in this manner would also make the reminder more mobile and versatile, given its reduced size.

Figure 4:
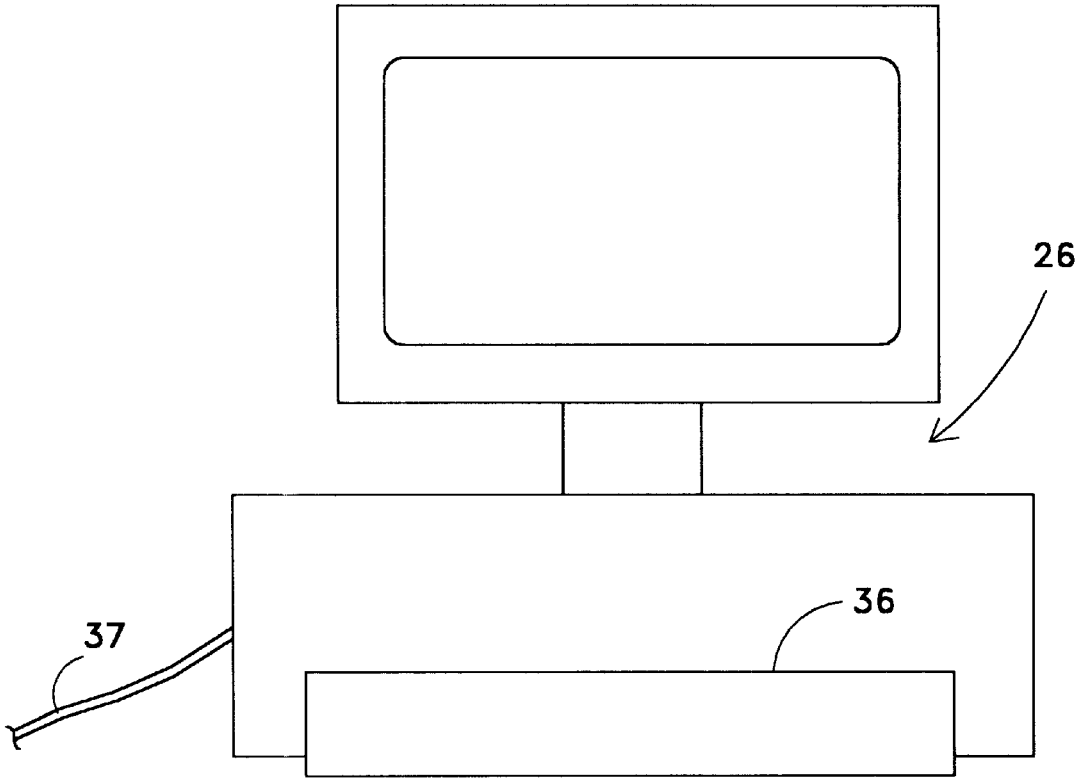
FIG. 4 is a diagrammatic view of a personal computer connectedable to the microprocessor of FIG. 2.

The overriding benefit of the pill dispensing system of the present invention is the possibility of eliminating the need for the user to physically input such information into the unit. In this way, no alpha/numeric keyboard is required on the case, nor is any sophistication required by the user to operate the unit. However, as previously noted, there may be times where it would be practical for the user to input data himself. To this event, the pill dispensing system utilizes a method for user information input that, likewise, requires little or no sophistication by the user and significantly simplifies the task. As shown in FIG. 4, a personal computer 36 could be used by the patient who is computer literate to program the microprocessor of FIG. 2. The patient could be provided with a program to assist him to input data in an appropriate format via the conventional keyboard 37. The personal computer 36 could transmit data through a parallel or serial cable 38 or by wireless means or by any other data transmission method.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

We claim:

1. A medicament dispensing reminder for assisting a patient to remember to take one or more medicaments at a preferred time comprising:

a case for supporting circuitry;

a microprocessor held by said case including means for programming the microprocessor and data output means, said microprocessor including timing circuitry which includes a 24 hour clock and said microprocessor including a memory module capable of sending medicament identifying indicia to an output port to identify an individual medicament at a pre-programmed time;

data link interface for receiving programming information connected to said microprocessor for inputting medicament dosage times, conditions, and name identifying indicia for a set of time intervals for each successive 24 hour period;

programming information sending means independent of said case to permit programming said microprocessor via said data link interface for receiving programming information;

a warning indicator held by said case including means to output a signal at a time when a medicament is to be taken;

a data display window held by said case to display alpha/numeric data received from the output port of said microprocessor relating to the medicament to be taken;

means for inputting power to said microprocessor held by said case for connection to a source of electrical energy; and a medicament holding case separated from said microprocessor.

2. The medicament dispensing reminder of claim 1 wherein said case includes a plurality of compartments for holding a medicament.

3. The medicament dispensing reminder of claim 1 wherein said data display window is a liquid crystal display screen.

4. The medicament dispensing reminder of claim 1 further including a warning signal generating unit independently attachable to said case for transmitting a warning signal from said warning unit upon receiving an output signal from said microprocessor.

5. The medicament dispensing reminder of claim 1 wherein said warning indicator is an audible signal outputting device.

6. The medicament dispensing reminder of claim 5 wherein said warning indicator further includes a luminous indicator.

7. The medicament dispensing reminder of claim 1 wherein said warning indicator is a vibrating signal outputting device.

8. The medicament dispensing reminder of claim 7 wherein said warning indicator further includes a luminous indicator.

9. A medicament dispensing reminder for assisting a patient to remember to take one or more medicaments at a preferred time comprising:

a case for supporting circuitry;

a microprocessor held by said case including means for programming the microprocessor and data output means, said microprocessor including timing circuitry which includes a 24 hour clock and said microprocessor including a memory module capable of sending medicament identifying indicia to an output port to identify an individual medicament at a pre-programmed time;

data link interface for receiving programming information connected to said microprocessor for inputting medicament dosage times, conditions, and name identifying indicia for a set of time intervals for each successive 24 hour period;

programming information sending means independent of said case to permit a medicament dispensing professional to program said microprocessor via said data link interface for receiving programming information when a medicament is dispensed;

a warning indicator held by said case including means to output a signal at a time when a medicament is to be taken;

a liquid crystal data display window held by said case to display alpha/numeric data received from the output port of said microprocessor relating to the medicament to be taken;

means for inputting power to said microprocessor held by said case for connection to a source of electrical energy; and a medicament holding case separated from said microprocessor.

10. The medicament dispensing reminder of claim 9 wherein said warning indicator is an audible signal outputting device.

11. The medicament dispensing reminder of claim 10 wherein said warning indicator further includes a luminous indicator.

12. The medicament dispensing reminder of claim 9 wherein said warning indicator is a vibrating signal outputting device.

13. The medicament dispensing reminder of claim 12 wherein said warning indicator further includes a luminous indicator.

14. A medicament dispensing reminder programmable by a personal computer for assisting a patient to remember to take one or more medicaments at a preferred time comprising:

a case for supporting circuitry;

a microprocessor held by said case including means for programming the microprocessor and data output means, said microprocessor including timing circuitry which includes a 24 hour clock and said microprocessor including a memory module capable of sending medicament identifying indicia to an output port to identify an individual medicament at a preprogrammed time;

data link interface for receiving programming information connected to said microprocessor for inputting medicament dosage times, conditions, and name identifying indicia for a set of time intervals for each successive 24 hour period;

programming information sending means comprising a personal computer independent of said case to permit programming said microprocessor via said data link interface for receiving programming information;

a warning indicator held by said case including means to output a signal at a time when a medicament is to be taken;

a data display window held by said case to display alpha/numeric data received from the output port of said microprocessor relating to the medicament to be taken;

means for inputting power to said microprocessor held by said case for connection to a source of electrical energy; and a medicament holding case separated from said microprocessor.

* * * * *